United States Patent [19]

Bohmer et al.

[11] 4,081,227

[45] Mar. 28, 1978

[54] SLIP FORM

[76] Inventors: Walter Bohmer, Everskamp 31, 4035 Brietscheid; Stefan Falticko, Eifelstrasse 25, 565 Soligen, both of Germany

[21] Appl. No.: 678,214

[22] Filed: Apr. 19, 1976

Related U.S. Application Data

[63] Continuation-in-part of Ser. No. 502,847, Sep. 3, 1974, abandoned.

[30] Foreign Application Priority Data

Sep. 3, 1973 Germany ..... 2344402

[51] Int. Cl.[2] ..... E04B 1/16; E04B 1/04

[52] U.S. Cl. ..... 425/65; 425/213; 249/20; 249/17

[58] Field of Search ..... 249/10, 17, 19, 20, 249/22, 23, 24; 425/63, 65, 213

[56] References Cited

U.S. PATENT DOCUMENTS

| | | | |
|---|---|---|---|
| 907,438 | 12/1908 | Axium | 249/48 X |
| 1,022,960 | 4/1912 | Merillat | 249/180 |
| 1,096,792 | 5/1914 | Mumford | 425/65 X |
| 1,198,469 | 9/1916 | Merillat | 249/180 |
| 1,471,387 | 10/1923 | Diamond | 249/194 |
| 2,492,502 | 12/1949 | Salmon | 249/22 |
| 2,779,990 | 2/1957 | Van Den Bos | 249/189 |
| 2,976,596 | 3/1961 | Williams | 249/10 X |
| 3,045,313 | 7/1962 | Dorn | 425/213 |
| 3,252,199 | 5/1966 | Bossner | 249/20 X |
| 3,497,579 | 2/1970 | Barron | 425/63 X |
| 3,659,982 | 5/1972 | Svensson et al. | 249/20 X |

FOREIGN PATENT DOCUMENTS

| | | | |
|---|---|---|---|
| 1,300,200 | 6/1962 | France | 425/63 |
| 1,559,092 | 9/1969 | Germany | 249/17 |
| 1,434,472 | 4/1969 | Germany | 425/63 |
| 2,151,663 | 1/1973 | Germany | 425/63 |
| 2,344,402 | 4/1975 | Germany | 425/63 |
| 68,322 | 2/1951 | Netherlands | 249/192 |

*Primary Examiner*—J. Howard Flint, Jr.
*Attorney, Agent, or Firm*—Sherman & Shalloway

[57] ABSTRACT

A slip form for walls or chimneys including opposed frames each carrying form members, the opposed frames being adjustably tied together across the wall to be poured and further positioned and braced by scissor-arms extended between adjacent frames along the same side of the wall.

20 Claims, 7 Drawing Figures

SLIP FORM

This application is a continuation-in-part of application Ser. No. 502,847, filed Sept. 3, 1974, now abandoned.

BACKGROUND OF THE INVENTION

The present invention relates to slip forms for concrete walls and is concerned, more particularly, with slip forms for curved walls such as chimneys or smokestacks.

Such slip forms typically are supported on the finished or "set" portion of the wall and are moved upwardly therewith as the wall progresses. The two sides of the form are tied together across the wall close to the pouring level and, with curved walls, the respective sides are trussed into the desired arc by means of longitudinally adjustable trusses.

However, certain problems have been encountered, particularly regarding the adjustment of the diameter of the form surfaces to produce the desired diameter of poured wall.

This is particularly true in the case of circular structures, such as stacks, in which accuracy of form placement requires expensive equipment and considerable effort in adjusting, checking and readjusting. All of this is further compounded if the stack is to be formed with an upward taper.

Furthermore, prior slip forms are unsuitable for structures which are to flare upwardly and thus increase in cross-section as the height increases.

Therefore, prior slip form have not been found to be entirely satisfactory.

SUMMARY OF THE INVENTION

In general, the preferred form of the present invention comprises a slip form having a plurality of opposed carrying frames arranged in pairs and carrying forming members, and scissor arms extended near the pouring level and between corresponding frames of adjacent pairs to position and brace the assembly along the wall surface.

The carrying frames are joined at a higher level and are further positioned and braced by scissor arms extended therebetween, adjacent the upper level, and are tied together by an adjustable brace arm adjacent their hinge point.

OBJECTS OF THE INVENTION

It is an object of the present invention to provide a slip form for walls which is readily and accurately adjustable to the contour desired.

It is a further object of the invention to provide a slip form for curved walls which is readily and accurately adjustable to the curved contours.

It is another object of the invention to provide a slip form which is readily and accurately adjustable to form a wall which is closed against itself.

It is a further object of the invention to provide a slip form which is readily and accurately adjustable to form a wall which is closed against itself and which changes in diameter or thickness along its height.

It is a still further object of the invention to provide a slip form which is readily and accurately adjustable to form a curved wall which is closed on itself and which is uniform in cross-section.

It is another object of the invention to provide a slip form which is readily and accurately adjustable to form a curved wall which is not uniform in cross-section.

A still further object of the invention is the provision of a slip form which is readily and accurately adjustable to form a wall having at least one non-vertical surface.

It is a special object of the invention to provide a slip form for stacks and like structures which is readily and accurately adjustable to the desired contour, contour changes and dimensional changes of the structure.

BRIEF DESCRIPTION OF THE DRAWINGS

These and other objects of the invention and a better understanding thereof will be apparent in the following description and accompanying drawings, in which.

DETAILED DESCRIPTION OF THE PREFERRED EMBODIMENT

Figure 1:
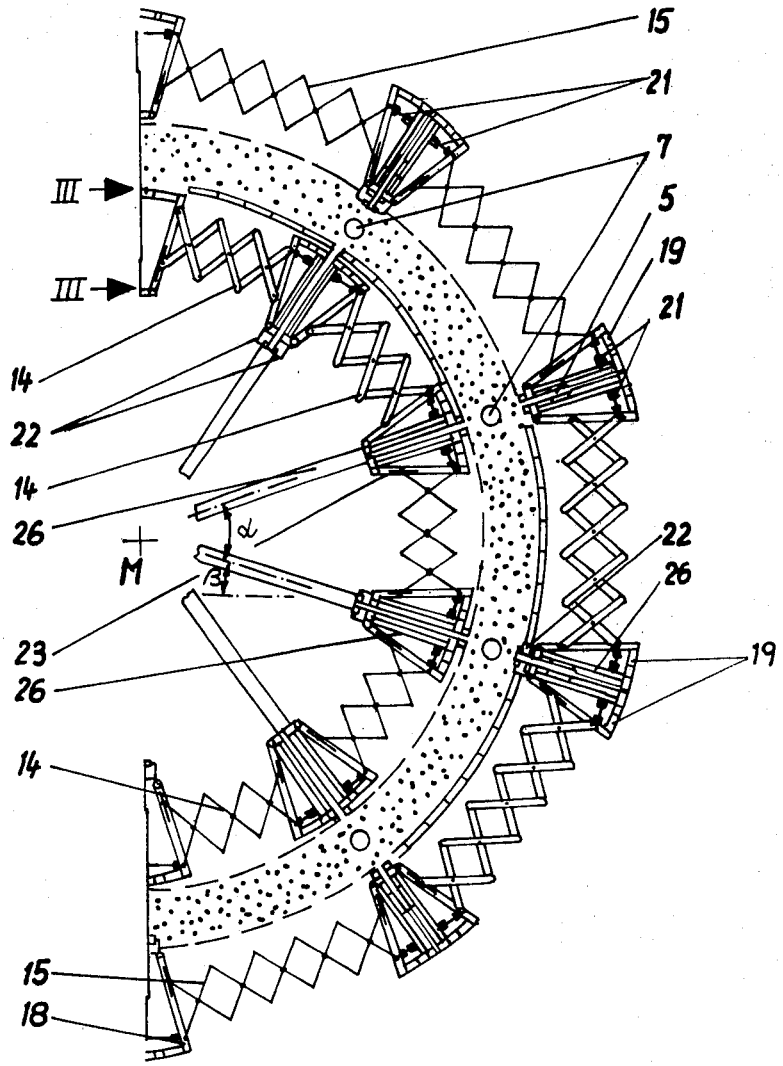
FIG. 1 is a sectional plan view of a circular-wall slip form according to the invention and taken along lines I — I of FIG. 2.

As shown in the drawings, the preferred form of the present invention comprises a slip form 1 for pouring a circular structure such as a smoke stack.

The slip form 1 includes a first course of a plurality of inner, convex form members 2 and a second course of outer, concave form members 3, which are suitably interlocked and are supported on inner carrying frames 4 and outer carrying frames 5, respectively. The inner and outer carrying frame members 4 and 5 are bridged or joined by a connector 6 which, in turn, is supported on the wall being cast by rods 7, which engage a solid portion of the wall, such as a footing or an earlier-cast, solid portion and, in essence, support the slip form on the wall. Lifting means, such as jacks 8, are provided between embedded rods 7 and the connectors 6. The jacks 8 function in a manner, well known in the art, to lift the upper part of the bar system. Since the entire slip form 1 is supported vertically by the bar system, and the lifting means 8 are inserted in the bar system, the lifting means can raise the slip form. The slip form 1 represents a constructional bracing, stable within itself, on the basis of its closed circular shape, which requires no further technical characteristics, in order to be stable in a radial or horizontal direction. In the vertical direction, the slip form is supported by the system of embedded bars 7 supported by the finished wall or by a base part.

Figure 2:
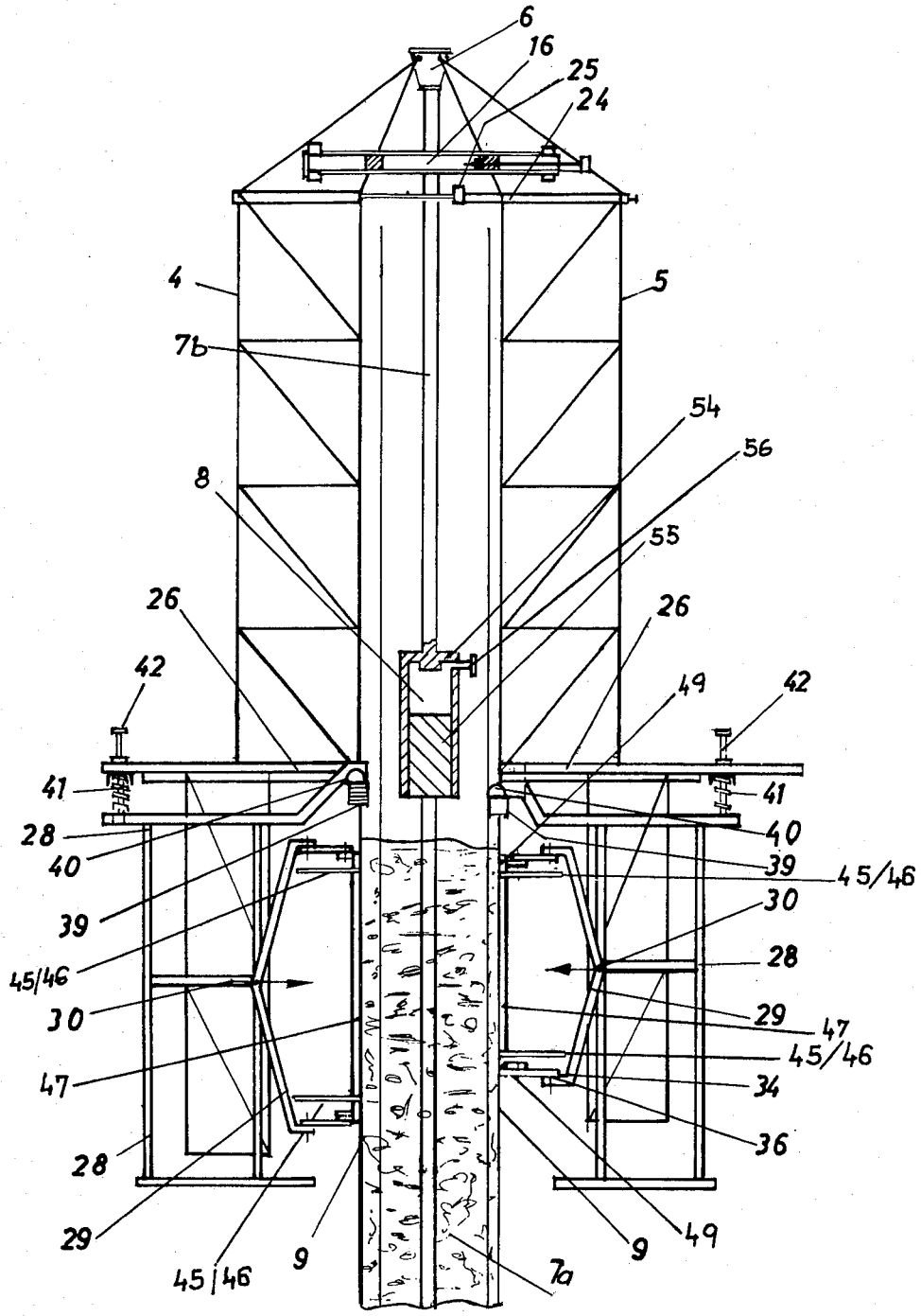
FIG. 2 is a transverse sectional view of a portion of FIG. 1 and taken along lines III—III of FIG. 1.

Preferably, the lifting apparatus formed by the jacks 8 is inserted between two parts *7a* and *7b* of the rod 7, as is shown in FIG. 2 in a disproportionately large scale. The lifting apparatus 8 may utilize a hydraulic piston-cylinder arrangement, in which a piston 55 is connected with the part *7a* of the rod, while a cylinder 54 is attached to the part *7b* of the rod. Pressure is introduced into cylinder 54 through a line 56. The pressure is applied simultaneously for all lifting apparatuses 8 of the entire structure, whereby the entire structure is raised by raising the parts *7b* vis-a-vis the parts *7a*.

Whenever the end of a hoisting path is reached, the structure is supported in a suitable manner or deposited onto some other fixed points, so that the parts 7*a* of the rod 7 can be pulled from the wall material, which has not yet set.

In practice, the rod 7 may be a hollow rod, and a second supporting rod may be supported therein. The latter remains fixed in the finished wall. The hoisting apparatus 8 has a double action system of clamping cheeks and can be supported by the inner rod, while the outside pipe is readjusted subsequently.

The inner and outer form members 2 and 3 support a plurality of adjoined form plates or shutterings 9, which form the actual casting or forming surface. The number of frames 4 and 5 and associated plates 9 are selected to provide the required diameter of the inner and outer surfaces of the wall being poured. The angle "$\alpha$" between the radial positions of pairs of inner and outer frames 4 and 5 also is a function of the number of frame-pairs employed.

Adjacent frame-pairs are positioned and braced against each other by adjustable scissor-arms. The adjacent inner frames 4 are connected by scissor arms 14; the adjacent outer frames 5 are connected by scissor arms 15; and adjacent connector points 6 are joined by scissor arms 16.

The scissor arms 14, 15 and 16 terminate at their opposite ends, in brace members 17 and 18, respectively. Pairs of brace members 17 and 18 are secured to their adjacent frame structure by a relatively long brace arm 19 and an inner, relatively short brace arm 20. The longer brace arms 19 include length-adjusting means, such as sliding members and clamps or turnbuckles 21, and the shorter brace arms 20 have turnbuckles 22 associated therewith for adjustment of the scissor-and-brace assembly.

In order to permit adjustment and securing of the scissor arms and the structure, the brace members 17 and 18 include one slotted aperture 23 for engagement by their respective scissor arms. The scissor arms and the associated groups of brace members 17, 18 and brace arms 19 and 20 thus can be adjusted to the required angle "$\beta$", with regard to a radial line from the center "M" through the pairs of frames 4 and 5, to provide the desired diameter of the member to be cast. The center "M" is the center line or axis of the circular structure under construction. The center line contains the point from which other structure radiates or is radial to advantageously, the adjusting turnbuckles may be operated by common drive means, not shown, to synchronize adjustment of the inner and outer form portions and of adjacent form sections.

The inner and outer form walls thus may be adjusted, as desired, to provide a required diameter of wall surface, with the pairs of inner and outer carrying frames being maintained in their radial orientation to provide optimum load-carrying ability. Where the desired wall diameter exceeds the adjusting limits of a given number of frame pairs 4 and 5 and associated form members 2 and 3, these components can be added or removed to provide the requisite dimensions.

In the region adjacent the connectors 6, the inner and outer frame members 4 and 5 are joined by radial tie bars 24 having length-adjusting means, such as a turnbuckle 25, to regulate the parallelism, convergence or divergence of the frames 4 and 5 and their associated forming members 2 and 3.

Figures 3, 4:
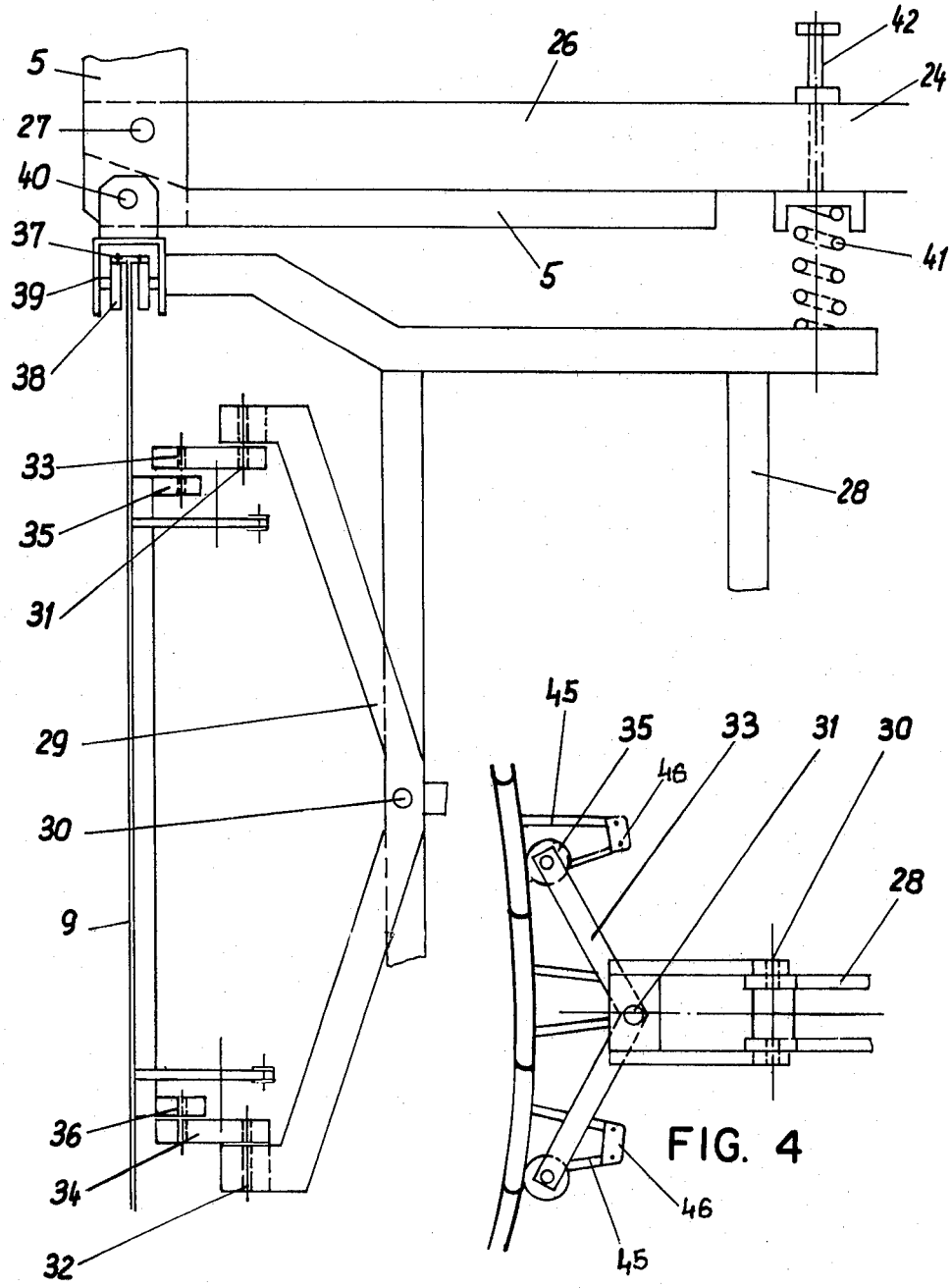
FIG. 3 is an enlarged view of a portion of FIG. 2.
FIG. 4 is a plan view of the structure of FIG. 3.
Figure 5:
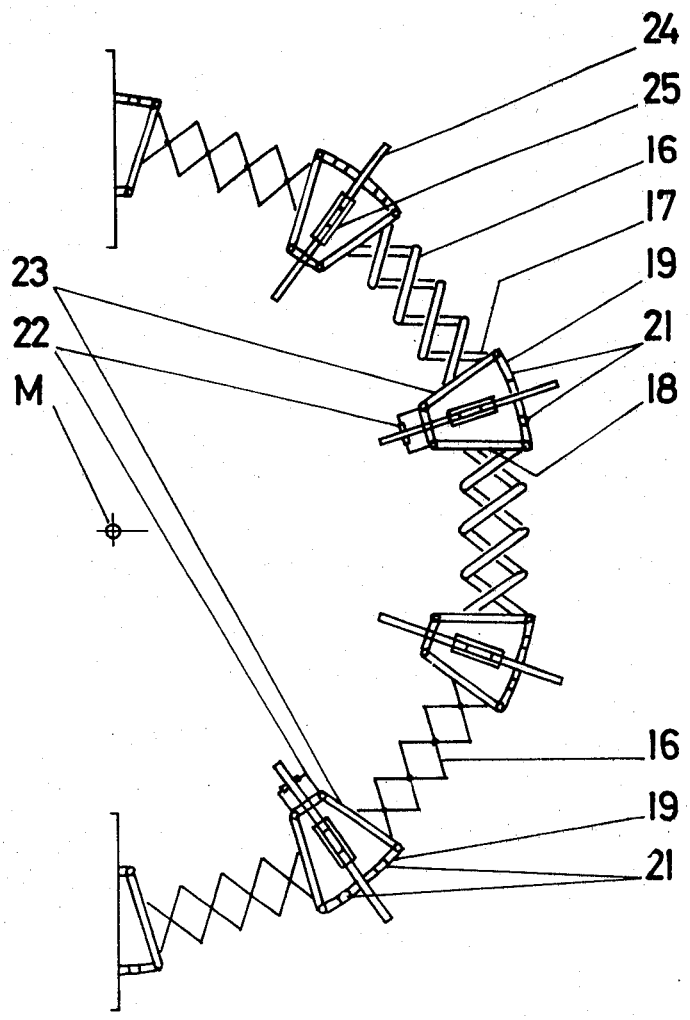
FIG. 5 is a view similar to FIG. 1 with portions removed to show the details of the scissor-arm bracing.
Figure 6:
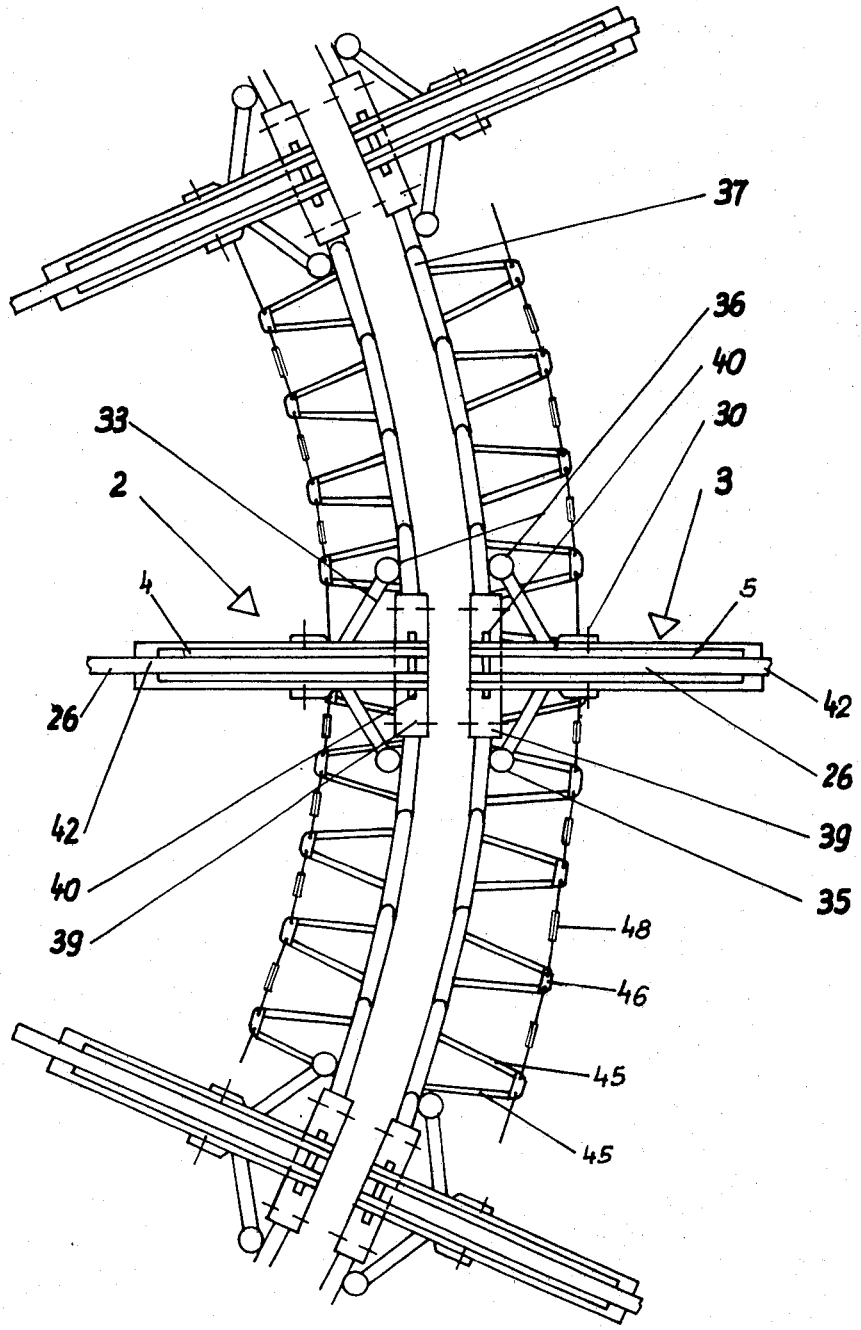
FIG. 6 is a sectional plan view of a portion of the form taken along lines VI—VI of FIG. 2.

The inner and outer frame members carry platform mounts 26 mounted thereon by means of a hinge 27. The forming members 2 and 3 include lateral frames 28 mounted on their respective carrying frames 4 or 5 and extended downwardly along the vertical extent of their associated form plates 9. At about the mid-point of each of the lateral frames 28, a "U" bracket 29 is mounted thereon by means of a substantially horizontal hinge 30. The "U" bracket 29 terminates with substantially vertical hinge points 31 and 32, at its remote end, which mount "V" brackets 33 and 34, respectively. The "V" brackets each carry rollers or wheels 35 and 36, respectively, which bear against the surface of the adjacent form plates 9. The sheet metal sheathings 9 are held together in peripheral direction by a structural unit, the structure of which is best seen in FIGS. 3, 4 and 6. Each sheet metal sheathing 9 is engaged at both an upper and a lower area with upper and lower horizontal braces 45, which have an upper and a lower connecting pieces 46. The braces 45 are interconnected in a perpendicular direction with braces 47. These parts constitute a form-stable frame for each sheet metal sheathing 9, and are interconnected in a peripheral direction by upper and lower tightening screws 48, which are only shown in FIG. 6, and which are flexibly connected by the connecting cables or the like to pieces 46. In this manner, the inside sheet metal sheathings 9 and the outside sheet metal sheathings 9 are combined in the peripheral direction to form a stable structural unit.

As is seen in FIG. 3, each sheet metal sheathing 9, at its upper end, has a horizontal flange 37, which is held in the area of one pair of carrying yokes 4 and 5 by U-shaped rails 39, which have rollers 38, which fit beneath the flange 37. An additional guidance in a peripheral direction likewise takes place in the area of carrying yokes 4, 5 with the help of the rollers 35 and 36. The rollers 35 and 36 do not run directly on the sheet metal sheathings 9, but on square abutting surfaces 49 attached to them. At their ends, remote from the hinge points 40, the lateral frames 28 are engaged by springs 41 mounted with adjusting screws 42 on a portion of a frame 4 or 5, such as on the adjacent portion of the platform mounts 26. This adjustment, together with the hinge points 40, permits an angularity between the lateral frame 28 and its associated form plate 9, with each other and with regard to the inner or outer frame member, 4 or 5, on which it is mounted.

If desired, the hinge points 27, of platform mounts 26 and 40, of the lateral frames 28, may be arranged to coincide on the associated frame 4 or 5. Preferably, the inner and outer scissors 14 and 15 are positioned closely adjacent the level or levels at which hinge points 27 and 40 are placed.

OPERATION OF THE PREFERRED EMBODIMENT

In operation, the required number of form members 2 and 3 and frame-pairs of inner frames 4 and outer frames 5 are assembled and adjusted via the scissors 14 and 15 to establish the desired wall diameter. Orientation of the frame pairs 4/5, with regard to the vertical and each other, is maintained by adjustment of the upper scissors 16.

By shifting the spindle drives 22, the effective length of the scissors 14, 15 and 16 can be changed in a peripheral direction, because one terminal part of one of the scissors is always shifted in the elongated hole 23.

Whenever the effective length of the scissors 14, 15 and 16 is shortened, there will be a decrease of the diameter.

The desired wall thickness is established by adjustment of the turnbuckle 25 on tie bar 24. Any undesirable angulation or divergence of the form plates 9 can then be adjusted by means of the adjusting screws 42, acting through the springs 41, which change the angle of the form members 2 and 3, with regard to the frame members 4 and 5, about the hinge points 40.

The various adjustable members, it should be noted, are self-locking in their adjusted positions to avoid distortion of the adjusted position of the form. The hinges may be locked by means of bolts, not shown.

When desired, the slip form of the present invention permits either an upward-narrowing or an upward flaring of the overall size of the cast structure.

Shortening of the upper scissor arms 16, which draws the several connectors 6 toward a smaller circle, causes the frame pairs 4/5 to lean inwardly toward the center "M", thereby producing a structure which tapers inwardly from its base.

Conversely, lengthening of the scissor arms 16 would cause the frame pairs 4/5 to veer outwardly to produce an upwardly flaring structure.

In either of the above cases, the thickness of the wall being cast may be either uniform or widened or thinned, as desired, by proper adjustment of turnbuckles 25 and screws 42, in conjunction with the adjustment of the scissor arm 16.

Also, it is to be understood that a given structure may be tapered for a portion of its height and widened for another portion of its height. When limits of expansion or constriction of the form diameter are reached, in such cases, the respective addition or removal of form members 2 and 3 will permit continued divergence or convergence of the structure.

It is important that the adjustments to the scissors 14, 15 and 16 and the tie bars 24 be synchronized or so correlated as to avoid dimensional interferences with resulting stresses which, if excessive, could damage the frames 4 and 5 and other portions of the slip form structure.

Suitable platforming or decking, not shown here for simplicity, is installed for worker access.

As the structure is poured, the hydraulic load acting against the form sheets 9 are confined by the scissor arms 14 and 15 through the supporting and bracing structure by which the plates are positioned.

Since the circle of plates fixed by the outer scissors 15 cannot expand, and the circle of plates fixed by the inner scissors cannot contract, separation of the inner and outer form surfaces cannot occur. Therefore, crossties or transverse tie bars in the work zone, which restrict the activity of workers on the platform, are not necessary. This, coupled with the overhead clearance permitted by joining frame pairs 4/5 at the high elevation of the connectors 6, permits free access of the workers at the pouring level.

It should be noted that the arrangement of crossed hinges 30, 31 and the spaced rollers 35, 36 are particularly effective in providing a smooth, uniform transfer of radial loads to the frames 4, 5 and their scissor arms 14 and 15. With the crossed hinges, the plate-bracing structure is self-aligning to provide uniform stress on both arms of the V bracket 33 and of the U bracket 29. The rollers 35 and 36 are effective in conforming to the surfaces of the sheets 9 and in preventing side-loading of the bracing brackets as a consequence of any frictional forces.

The actual platforming for the workers can be adjusted to the horizontal, if the frames 4 and 5 are to be set off the vertical, by re-orientation of the arms 26 about their hinge points 27.

However, if desired, the frames 4 and 5 may be made with two adjusting tie bars, one of which replaces the connectors 6, so that the frames 4 and 5 may be maintained parallel in the course of adjusting the wall thickness, so that a re-orienting hinge point 27 and a lock would not be necessary. In this case, any required nonparellelism between the opposed plates 9 would be derived solely via the hinge point 40 and the screw 42.

Figure 7:
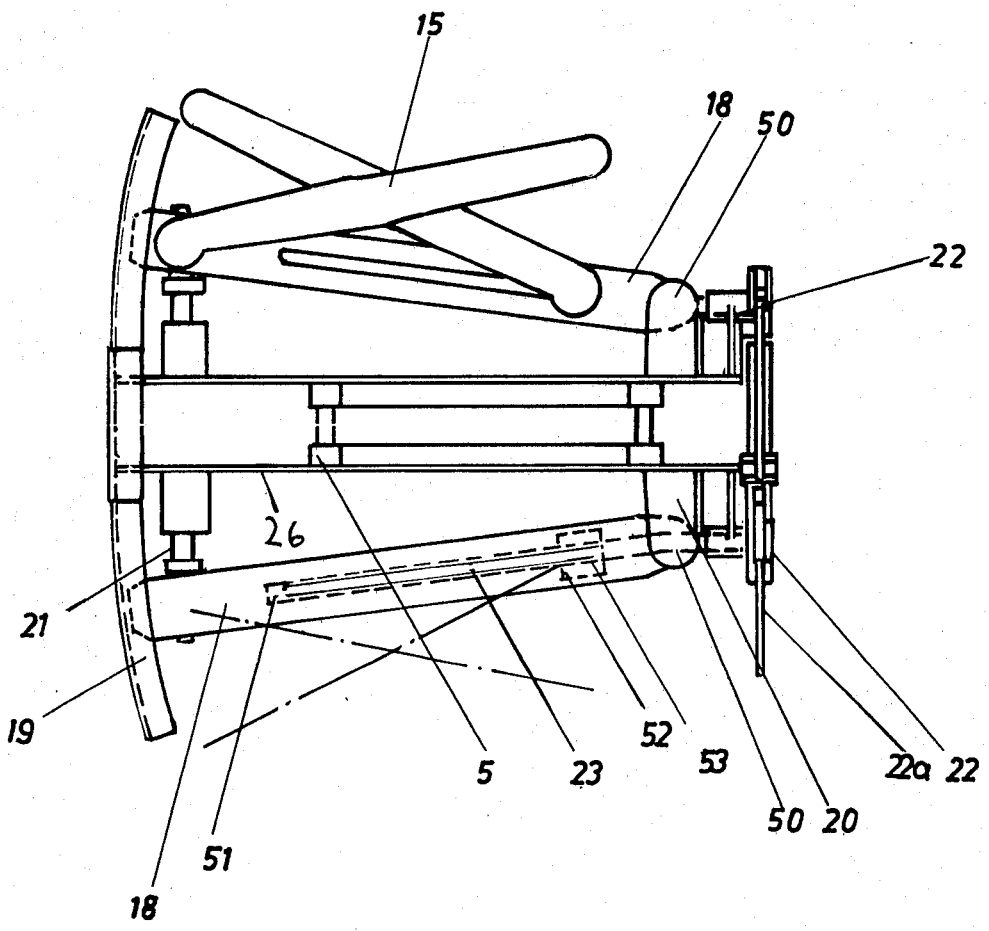
FIG. 7 is a top plan view of one connection between a scissor-arm and carrier yoke.

FIG. 7 shows the connection between the scissors 15 and the carrier yokes, and specifically the connection between a scissor 15 and the carrying yoke 5 of a platform support 26. A U-shaped scissor guide 19 is attached on said platform carrier on one side, the inside diameter of which opens in the direction toward the arms 18 of the scissor. The latter are pivotally mounted by a joint 50, which is positioned at the end of a bearing arm 20 extending from the platform carrier 26 in both directions. The pertinent swivelling position of the scissor arms 18 is predetermined by a positioning drive 21, which can be in the form of a spindle drive. As a result of this arrangement, the pertinent required angle $\beta$ can be adjusted (see FIG. 1).

The scissor arms 18 have square hollow cross-sections, which are equipped with oblong slots 23. Inside of the hollow cross-section a rotatable spindle 51 is disposed onto which a threaded nut 52 has been screwed. The threaded nut 52 is provided on both sides with a bolt 53 extending through the slot 23. One arm of a scissor 15 is pivotally attached to the bolt 53.

Each spindle 51 can be turned by an adjusting drive 22 with a worm gear type of connection to the spindle. A universal joint may be provided in the area of the joint 50. A rotational movement carried out by means of a hand lever **22*a* can be transmitted in this way to the spindle 51. The threaded nut 52 guided on said spindle is adjusted (shifted) correspondingly across the length of the slot 23, so that the crossing angle of both legs of the scissor 15** can be adjusted.

While the preferred slip form of the present invention has been detailed in terms of a circular smoke stack, it is to be understood that the form of the present invention may be employed in the production of silos, cooling towers or similar structures.

Furthermore, structures of other than true circular cross-section are possible with the slip form of the present invention and the cross-sectional shape of the structure may be of any desired shape, including a nonclosed or open structure such as an arch. Aligned horizontally, slip forms according to the present invention may be used advantageously in the pouring of arched ceilings, bridge arches and the like.

Therefore, it is apparent that the present invention provides a particularly advantageous slip form capable of previously unknown versatility. The scissor-arm bracing permits structures of considerably larger diameters than safely possible heretofore, while the full system permits slip-form pouring of structural shapes not previously possible with the slip-form technique.

Various changes may be made in the details of the invention, as described, without sacrificing the advantages thereof or departing from the scope of the appended claims.

I claim:

1. A slip form for molding a wall of a structure, wherein the slip form comprises:

(a) means for supporting said slip form, wherein said slip form supporting means projects upwardly from finished portions of the wall;

(b) means for lifting said slip form, wherein said lifting means are mounted on said slip form supporting means;

(c) connecting means mounted on said slip form supporting means and spaced from the finished portions of the wall;

(d) inner carrying frames and outer carrying frames;

(e) means for suspending said inner carrying frames and outer carrying frames from said connecting means so that said frames extend from the connecting means to and along the inner and outer surfaces of the wall;

(f) means for adjusting the transverse distance between the inner carrying frames and outer carrying frames, said means disposed adjacent said connector means, above said frames, and between said suspending means to allow the carrying frames to adjust for walls of different thickness;

(g) inner and outer form plates for engaging said wall and molding material into finished portions of said wall, said plates being adjustable along the periphery of said wall;

(h) lateral frame members pivoted to the inner and outer carrying frames about horizontal axes, which are substantially parallel to the extent of the wall, said lateral frame members engaging said form plates to hold said form plates in engagement with said wall;

(i) platform mounts pivotally attached to said carrying frames for mounting platforms upon which workers and material are supported;

(j) inner and outer spacing means extending between adjacent inner carrying frames and adjacent outer carrying frames for determining the spacing between adjacent frames and for rendering that spacing adjustable, said spacing means extending in a first plane adjacent the finished portion of the wall; and (k) wherein each inner carrying frame and each outer carrying frame form transversely aligned carrying frame pairs, and wherein upper adjustable spacing means extend between adjacent carrying frame pairs, said upper spacing means extending in a plane spaced upwardly from said first plane and adjacent said connecting means.

2. The slip form of claim 1, further including pivotal mounting means having horizontal axes for attaching said platform mount to said carrying frames, so that said platform mounts pivot, with respect to both the lateral frame members and form plates.

3. The slip form of claim 1 including means for securing the form plates adjacent one edge to the carrying frames, wherein said securing means allows movement of said form plates along the course of said wall being formed, said slip form, further including "U-shaped" brackets pivoted to said lateral frame members to swivel about horizontal axes, wherein one arm of the "U-shaped" brackets applies pressure to the form plates along an area adjacent said one edge and the other arm of the "U-shaped" brackets applies pressure to the form plates along an area adjacent said one edge and the other arm of the "U-shaped" brackets applies pressure to the form plates along an area adjacent the other edge.

4. The slip form of claim 3, further including branched brackets attached to each arm of the "U-shaped" brackets, wherein each branch has a roller thereon, which engages the form plates, and wherein the rollers rotate about an axis parallel to the extent of the "U-shaped" brackets and perpendicular to the axes of the "U-shaped" brackets.

5. The slip form, according to claim 1, wherein the first plane, in which the inside and outside spacing means are disposed, is proximate a plane defined by the platform mounts.

6. The slip form of claim 5, wherein the connecting means is spaced sufficiently from the first plane and the platform mounts to allow workers to stand and work on the platforms supported by the platform supports without obstruction by the connecting means.

7. The slip form of claim 1, wherein the spacing means are scissor arms and wherein adjacent scissor arms have brace members disposed therebetween; wherein the brace members include adjustment means for determining the extent of the scissor arms and, therefore, the distance between the brace members, and wherein the carrying frames are disposed to project from said brace members, so as to be movable toward and away from one another, in accordance with the extent of the scissor arms.

8. The slip form of claim 7, wherein the brace members each include a pair of struts, one of which is movable relative to the other in the direction in which the scissor arms expand and contract, so as to lengthen and shorten the scissor arms.

9. A slip form for erecting a wall of a building, said slip form having carrier yokes overlapping the wall of said building transversely in relation to the course of the wall and disposed over the cross section of the wall in a horizontal direction, wherein said yokes are adjustable in order to adjust the distance from one point of reference in a horizontal direction, said yokes being subdivided into inside and outside parts, longitudinally chageable scissors serving as parallel guides and connecting the carrier yokes in a first horizontal adjusting plane, inside and outside holding frames for inside and outside shuttering of sheet metal plates connected with the parts of the carrier yoke, said holding frames being adjustable vis-a-vis the parts of the carrier yoke around a horizontal axis lying in the direction of the periphery so that the parts of the carrier yokes of one carrier yoke are connected articulately above a support for a platform, a connecting member for supporting the carrier yokes and an adjusting member which is longitudinally adjustable between the two parts of the carrier yoke wherein the parts of the carrier yoke are mounted adjustably relative to one horizontal axis lying in the direction of the periphery vis-a-vis the support for the platform, and said carrier yokes being connected additionally by upper scissor arms above said inside and outside scissors which engage the carrier yokes in a second adjusting plane formed above the first adjusting plane.

10. A slip form as in claim 9, characterized in that below a part of the carrier yoke a holding frame for a plurality of metal shutter plates is mounted to pivot about an axis lying horizontally in the direction of the periphery.

11. A slip form as in claim 10, characterized in that the axes pivoting the holding frame lie above the metal shutter plates and that one adjusting member which is changeable longitudinally in a vertical direction engages between a part of the carrier yoke and the associated holding frame.

12. A slip form as in claim 10, characterized in that the metal shutter plates are suspended at an upper portion thereof around a horizontal axis lying in the direction of the periphery and in that the holding frame includes a two-arm support which rocks about a horizontal axis lying in the direction of the periphery which engages in a horizontal direction transversely to the course of the wall with one arm adjacent an upper area and the other arm adjacent a lower area of the metal shutter plate held by said holding frame.

13. A slip form as in claim 12, characterized in that a two-pronged fork which is swivelable around a vertical axis is mounted on the arms of the support and wherein the arms of the support lie in a horizontal plane and are always provided at their ends with a roller mounted to rotate about a vertical axis.

14. A slip form as in claim 9, characterized in that the inside and the outside scissors are disposed approximately at the level of a carrier for the platform support at the level of one of the carrier yokes while the connecting point of the two parts of the carrier yoke lies above the platform carrier.

15. A slip form as in claim 14, characterized in that the connecting point of the two parts of the carrier yoke lies high enough above the platform carrier so that a sufficient operating height is provided for individuals standing on the platform carrier.

16. A slip form as in claim 14, characterized in that each scissor is provided with a brace having a spindle drive and in that the driving sides of two adjacent scissors face the carrier yoke lying between them.

17. A slip form as in claim 14, characterized in that one scissors is provided at two ends with a brace extending transversely to the longitudinal axis of the scissors, wherein the brace is supported articulately with one end on a part of the carrier yoke, wherein a longitudinally changeable adjusting member is attached to the part of the carrier yoke which engages at the other end and adjusts the angle between the brace and the part of the carrier yoke.

18. The slip form of claim 2, wherein the lateral frame members are mounted on axes, which are positioned above the form plates, and wherein an adjustment means, spaced from said axes in a direction away from the wall being formed and disposed between the frame members and platform determines the angular orientation of the lateral frame, with respect to the direction of the carrying frames extended.

19. The slip form of claim 1 wherein said suspending means includes adjustable means for suspending said inner and outer carrying frames along selectable arcs about a common center.

20. The slip form of claim 19 wherein said adjustable means includes means for displacing said inner and outer carrying frames radially with respect to said common center.

* * * * *